US006565491B1

(12) United States Patent
Thompson et al.

(10) Patent No.: US 6,565,491 B1
(45) Date of Patent: May 20, 2003

(54) INERTIAL EXERCISE APPARATUS AND METHOD

(75) Inventors: Michael A. Thompson, Oconomowoc, WI (US); Allen Perkins, II, Jackson, WI (US)

(73) Assignee: I.K.E. Systems, LLC, Oconomowoc, WI (US)

( * ) Notice: Subject to any disclaimer, the term of this patent is extended or adjusted under 35 U.S.C. 154(b) by 0 days.

(21) Appl. No.: 09/637,971

(22) Filed: Aug. 11, 2000

(51) Int. Cl.[7] ..... A63B 21/22
(52) U.S. Cl. ..... 482/110; 482/148
(58) Field of Search ..... 482/110, 70, 72, 482/101, 102, 98, 99, 148

(56) References Cited

U.S. PATENT DOCUMENTS

| | | | | | |
|---|---|---|---|---|---|
| 3,614,097 | A | * | 10/1971 | Blickman | 272/81 |
| 4,632,392 | A | | 12/1986 | Peyton | |
| 4,781,372 | A | * | 11/1988 | McCormack | 272/70 |
| 5,334,120 | A | * | 8/1994 | Rasmussen | 482/97 |
| 5,989,163 | A | * | 11/1999 | Rodgers, Jr. | 482/70 |
| 6,004,248 | A | * | 12/1999 | Price | 482/121 |
| 6,106,442 | A | * | 8/2000 | Tissue | 482/71 |

OTHER PUBLICATIONS

Impulse Inertial Exercise System manufactured by E.M.A., Newnan, GA.

* cited by examiner

*Primary Examiner*—Nicholas D. Lucchesi
*Assistant Examiner*—Lori Baker Amerson
(74) *Attorney, Agent, or Firm*—Michael Best & Friedrich LLP

(57) ABSTRACT

An inertial training apparatus and method utilized for strength training and rehabilitation strength training of muscles. The inertial training apparatus and method allows for generation of rotational inertial forces by accelerating a mass by a concentric contraction of a muscle and converting the rotational inertial forces of the mass into a substantially equivalent eccentric action of the muscle used to decelerate the mass. A tether is coupled between the mass and a body part to transfer the tension forces provided by the body part to accelerate the mass and, in turn, those provided by the body part to decelerate the mass. A swing arm and a mass on the swing arm are rotatably mounted to a frame to preferably allow for low-friction rotation about a substantially vertical axis. A primary tether guide is preferably coupled to the frame and can be positioned near an intermediate rotational position of the swing arm where acceleration forces are transferred into deceleration forces. The tether is positioned through the primary tether guide and has one end attached to the swing arm and another end attached to a handle that engages the body part. The inertial training apparatus and method also allow for cyclical repetition of muscular loading caused by the acceleration and deceleration forces of the mass.

27 Claims, 1 Drawing Sheet

INERTIAL EXERCISE APPARATUS AND METHOD

FIELD OF THE INVENTION

The present invention relates to inertial exercise equipment, and more specifically, to apparatuses and methods for substantially uniform transition between eccentric actions and concentric contractions of muscles.

BACKGROUND OF THE INVENTION

Generally, muscles undergo a number of different types of contractions during everyday activity. A concentric or isotonic contraction is a shortening of the muscle when the muscle is acting under tension. An isometric contraction occurs when the muscle is under tension but maintains a constant length. An eccentric muscle action is a lengthening of the muscle when the muscle is acting under tension.

Under typical circumstances, concentric contractions of a muscle oftentimes produce an acceleration of an object, whereas eccentric actions of the muscle provide for the deceleration of the object. In other words, concentric contractions usually provide the activation or creation of energy in an object, while eccentric actions provide the braking effect. Most often, the transition between these two different types of muscle contractions occur at the peak of inertial energy. For example, when a pitcher throws a baseball at 80 miles per hour, concentric contractions of certain shoulder muscles accelerate the baseball and arm up to that velocity. When the arm and ball reach the peak of inertial energy, the pitcher releases the ball and the concentric contractions of that shoulder muscle transition into eccentric muscle actions that act to decelerate the velocity of the arm back to rest. During eccentric muscle actions, the inertial force created by the momentum of the pitching arm works against the muscle creating the muscle tension and elongation. Swinging a tennis racket, a baseball bat, and a golf club are other sports related examples illustrating a transition from concentric contractions to eccentric actions at the peak of inertial energy.

Eccentric muscle actions or deceleration activities produce muscle injuries more often than concentric contractions or acceleration activities. Strains are most often caused by over-loading a muscle, which usually results from a forced stretching of a contracted muscle. Because muscle tensions created by eccentric actions are generally much higher than those generated by concentric contractions and because more force can be generated during eccentric exercises, strains are commonly caused by eccentric muscle actions.

It is important to exercise muscles by eccentric training because such training is a very effective way to strengthen muscles, particularly for specific functional movements. Eccentric actions produce the maximum stress on the muscle-tendon unit, and it is necessary to strengthen the muscle-tendon unit to withstand these stresses in order to cope with and prevent injury caused by such eccentric muscle actions.

Studies have shown that when an eccentric action was the cause of an injury, the most effective rehabilitation program includes similar eccentric training exercises. Also, eccentric strength training produces better strength gains than concentric training and is a more effective form of rehabilitation strength training.

The most common strengthening technique utilizing a combination of concentric and eccentric contractions is simple weight lifting. However, weight lifting also includes resistance loads, specifically those caused by gravity. Therefore, the weightlifter is constantly working to overcome the resistance loads as opposed to concentrating on acceleration and deceleration forces. This does not provide the trainer with the beneficial transition of purely acceleration forces to deceleration forces. Rather, a weightlifter's muscles undergo concentric contractions when raising the weight to a rest position and undergoes eccentric muscle actions when the weight is being lowered to a rest position. In other words, when the weight is being lifted, the lifter does not use eccentric muscle action to decelerate the weight to the rest position. Instead, gravity is allowed to slow the velocity associated with raising the weights. In turn, when the weight is being lowered, the muscles do in fact undergo eccentric actions. However, there is no direct transition from concentric contractions, and the deceleration forces are increased substantially by the gravity force acting on the weight. More importantly, there is no inertial energy generated in the weight when the muscles transition from concentric contractions to eccentric contractions, as the weight begins from rest at this point.

A number of exercise techniques and equipment exist that employ acceleration and deceleration forces for concentric and eccentric muscle training. Although such techniques and equipment often provide for a uniform transition from concentric contracting to eccentric action of the muscles at the point of peak generated inertial energy, they each typically possess certain undesirable attributes.

For example, many inertial exercise devices and techniques utilize a mass that is connected (often by a tether) to a body part and that is slidable along a linear track. A body part accelerates the mass along the track, and thereafter the motion of the mass is converted to a motion that can be decelerated by the body part. An example of such a device is disclosed in FIG. 4 of U.S. Pat. No. 4,632,392 issued to Peyton et. al. Unfortunately, adverse resistance loads usually accompany such devices and techniques, and are caused by the friction of the mass sliding on the track. This friction load tends to increase the concentric contraction necessary to accelerate the mass, and tends to decrease the eccentric action necessary to decelerate the mass. The friction between the track and the mass is dependent upon the amount of mass used for the exercise. Therefore, the greater the mass used on the track, the larger the inequality between the acceleration and deceleration forces.

Other exercise devices and techniques employ one or more rotating or orbiting masses to harness rotational inertia forces for concentric and eccentric muscle training. Two examples of such devices and techniques are disclosed in FIGS. 1 and 5 of the Peyton Patent. In addition to the friction load problems described above, such devices and techniques can have limited adjustability. For example, where the mass moved is upon a track, adjustability is generally only possible by changing mass size (and not the mass path). As another example, the size of the exercise equipment is often fairly large, and can require balanced loading of multiple weights for proper operation (see FIG. 5 of the Peyton Patent).

In light of the above design requirements and limitations, a need exists for an inertial training apparatus which provides a substantially uniform transition between muscular concentric contraction and muscular eccentric action at the peak of generated inertial energy, provides substantially equal and proportional acceleration and deceleration forces, provides low or negligible resistance loads, provides for adjustment in magnitude and rotational radius of even a single weight to modify the acceleration and deceleration loads, and provides for ease of manufacture and minimal material costs. Each preferred embodiment of the present invention achieves one or more of these results.

SUMMARY OF THE INVENTION

The present invention is an inertial training apparatus and method preferably utilized for strength training and rehabilitation strength training of muscles. The present invention allows for the generation of inertial forces by accelerating a mass by a concentric contraction of at least one muscle and converts the inertial forces of the mass into an equivalent or substantially equivalent eccentric action of the muscle or muscle group used to decelerate the mass. The transition of acceleration forces into deceleration forces preferably occurs when the inertial energy of the mass reaches its peak. This deceleration is the reflexive stimulus resulting in increased concentric muscle contraction, which is a desired result of optimal strength training for power. Such power is generated by the utilization of stored elastic energy within the muscle being trained, and is the result of stretch reflex of the muscle (commonly referred to as the stretch-shortening cycle). Preferably, the inertia generated by the mass is rotational inertia. The mass is thereby preferably rotationally accelerated and rotationally decelerated about an axis. A tether can be coupled between the mass and a body part of a user to transfer the tension forces provided by the body part to accelerate the mass and, in turn, those provided by the body part to decelerate the mass. The inertial training apparatus also allows for cyclical repetition of the muscular loading due to the acceleration and deceleration of the mass.

In highly preferred embodiments of the present invention, the inertial training apparatus includes a frame and a swing arm. The swing arm is rotatably mounted to the frame to preferably allow for almost frictionless rotation about a substantially vertical axis. Because the movement is relatively frictionless, resistance forces interfering with the equality of the concentric and eccentric actions are negligible. Preferably, the mass is adjustably coupled to the swing arm. More preferably, the mass is capable of being positioned in variable locations along the length of the swing arm to modify the moment of inertia, effectively increasing or decreasing the forces necessary for the acceleration and deceleration of the mass. The acceleration and deceleration loads can therefore be varied by either moving the mass along the length of the swing arm or by increasing or decreasing the mass in a single position on the swing arm. Because the swing arm preferably extends only in one direction from the axis, an adjustment of a counterweight is not necessary such as would exist with a system utilizing a rotating disc. Preferably, the apparatus also includes a primary tether guide. More preferably, the primary tether guide is coupled to the frame and is positioned near the intermediate rotational position of the swing arm where acceleration forces are transferred into deceleration forces. Most preferably, the tether is positioned through the primary tether guide and has one end attached to the swing arm and another end attached to a handle. The handle can be easily and comfortably engaged by a body part of the user designated to exercise a certain identified muscle or muscle group.

In one preferred embodiment of the present invention, the inertial training apparatus includes a vertical assembly. Preferably, the vertical assembly includes a vertical member having an intermediate tether guide and an upper and lower tether guide coupled thereto. The tether preferably extends from the end of the swing arm through the primary tether guide, the intermediate tether guide, and finally through either the upper or the lower tether guide. The alternate upper and lower tether guides are provided to allow for more comfortable and effective exercise in either an elevated or lowered position.

More information and a better understanding of the present invention can be achieved by reference to the following drawings and detailed description.

BRIEF DESCRIPTION OF THE DRAWINGS

The present invention is further described with reference to the accompanying drawing, which show the preferred embodiment of the present invention. However, it should be noted that the invention as disclosed in the accompanying drawing is illustrated by way of example only. The various elements and combinations of elements described below and illustrated in the drawings can be arranged and organized differently to result in embodiments which are still within the spirit and scope of the present invention. In the drawing, wherein like reference numerals indicate like parts.

DETAILED DESCRIPTION OF PREFERRED EMBODIMENTS

Figure 1:
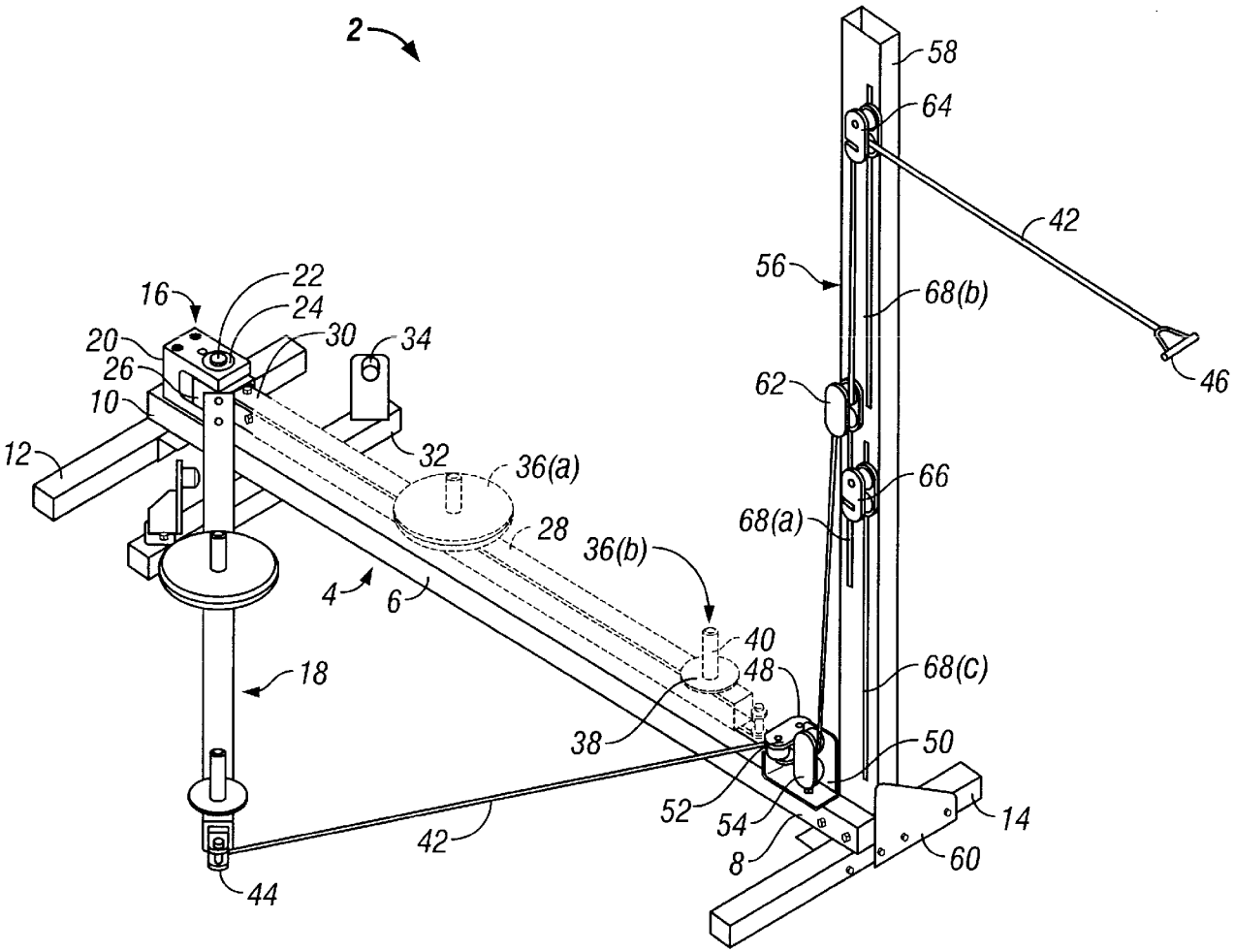
FIG. 1 is a perspective view of an inertial training apparatus according to the present invention.

FIG. 1 illustrates an inertial training apparatus 2 embodying the present invention. The inertial training apparatus 2 has a frame 4. The frame 4 has a base beam 6 having a forward end 8 and a rearward end 10. The forward end 8 is defined as the end proximately located to the exercising position. Preferably, the base beam 6 is hollow and is fabricated from a metal extrusion having a rectangular or square cross-section. The shape of the base beam 6 need not be straight as shown in FIG. 1, but can take any shape desired. The base beam 6 need only provide sufficient strength characteristics to provide resistance against bowing and flexing in the apparatus.

The frame 4 preferably has at least one stabilizer, and more preferably has a pair of stabilizers 12, 14 that provide an adequate and stationary base to the inertial training apparatus 2 while at rest and while in motion. Preferably, the rearward stabilizer 12 is coupled at its center to the rearward end 10 of the base beam 6 and the forward stabilizer 14 is coupled at its center to the forward end 8 of the base beam 6. The bottom surface of the stabilizers 12, 14 provide a sufficient frictional surface normal to the floor to prevent sliding of the inertial training apparatus 2 when in operation. Specifically, the stabilizers 12, 14 can be provided with one or more elements (e.g., feet, pads, material strips, bumps, and the like) made at least partially of low-slip material such as rubber, urethane, and the like, can have a coating or layer of a low-slip material thereon, or can even have a roughened, textured, or other surface resistant to slippage. The stabilizers 12, 14 preferably equally extend outwardly from both sides of the base beam 6 to prevent tipping in a direction perpendicular to the longitudinal direction of the base beam 6. In the preferred embodiment, the stabilizers 12, 14 are made from the same material as the base beam 6. However, any shape and material that provides the necessary support against tipping (during device operation and otherwise) will be an acceptable substitute.

It should be noted that throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical communication with another element. Examples include directly securing one element to another (e.g., via welding, bolting, gluing, frictionally engaging, mating, etc.), elements which can act upon one another (e.g., via camming, pushing, or other interaction) and one element imparting motion directly or through one or more other elements to another element.

The inertial training apparatus 2 also includes a pivot assembly 16 and a swing arm 18. It should be noted that FIG. 1 illustrates two possible swing arm positons and should not be interpreted as having two separate swing arms. In the preferred embodiment of the invention, the pivot assembly 16 includes a mount 20, a pin 22 and bearings 24. The mount 20 is preferably coupled to the top side of the rearward end 10 of the base beam 6. Preferably, the mount 20 is C-shaped and includes a top hole and a bottom hole for receiving the pin 22. The mount 20 is preferably made of steel to provide the necessary strength to support the swing arm 18 from a cantilevered position, extending outward from the axis of the mount 20. The pivot assembly 16 is not limited to the structure described in the preferred embodiment. The pivot assembly 16 can be made from other assemblies known to those of ordinary skill in the art that both support the swing arm 18 from one end and allow the rotation (preferably near frictionless) of the swing arm 18 about that end. Such pivot assemblies can be mounted to the base beam 6, to one or more stabilizers, or in any other location on the apparatus providing sufficient stability and strength to permit the swing arm to swing in a cantilevered fashion. The pivot assembly 16 can even be integral with the base beam or other apparatus frame members, if desired.

The swing arm 18 generally acts as a carriage to support a mass about a rotation axis. The swing arm 18 preferably includes an adapter 26 positioned within the pivot assembly 16 and an extension member 28 extending away from the adapter 26. The member 28 has a rearward end located near the pivot assembly 16 and a forward end located opposite the pivot assembly 16. The adapter 26 has a through hole in vertical alignment with the top and bottom holes of the mount 20. The pin 22 and bearings 24 are used in combination to support the swing arm 18 as well as to provide low-friction rotational movement of the swing arm 18 about its pinned axis. The adaptor 26 preferably includes a support boss 30 that extends outwardly from the adapter 26 and pivot assembly 16. The support boss 30 is configured to be inserted into the rearward end of the extension member 28 for coupling purposes. The support boss 30 provides the necessary strength to maintain the extension member 28 in a substantially horizontal position. The adaptor 26 and the support boss 30 are preferably made from a metal (steel, aluminum, or the like) or high strength plastic material capable of withstanding the increased stresses due to the moment caused by adding weight on the swing arm 18 a distance from its support axis. The adaptor 26 and the support boss 30 can be cast, machined, forged, welded or any combination thereof.

The illustrated configuration of the swing arm 18 and pivot assembly 16 represents only one preferred embodiment for the swing arm 18 and pivot assembly 16. A number of other devices and structures can be selected to accomplish the same functions of these elements. For example, the swing arm 18 could have a vertically aligned hole on one end through which the pin 22 passes (with or without a bearing), in which case the swing arm 18 can be made of one element (cast, extruded, or otherwise) or of multiple elements permanently assembled together (such as the swing arm 18 welded to the adapter 26). As another example, the swing arm 18 could be a pole having an end fitted within a socket in a body that is rotatable about the pin 22. Additionally, the swing arm 18 can include a pin at one end projecting 90 degrees to the swing arm's axis and fitted within an aperture in the base beam 6, rearward stabilizer 12, or other structural member of the apparatus' frame 4. This design can instead employ a pin projecting vertically upward and downward from the swing arm 18 and fitting into apertures in a mount or other part of the apparatus frame 4. As another example, one end of the swing arm 18 can be fastened around an upwardly extending rotatable pin 22 by using a collar or other suitable fitting. In short, any assembly or technique utilized to cantilever a beam that is pivotable through a substantially horizontal plane can be used and falls within the spirit and scope of the present invention. In each case, the beam, pole, lever, or other element(s) defining the swing arm 18 act (with or without a stacking post 36 or stacking plate 38 as described below) as a carriage for supporting, retaining, or otherwise holding one or more weights.

Preferably, the inertial training apparatus 2 also has an intermediate stabilizer 32. The center of the intermediate stabilizer 32 is preferably coupled to the base beam 6 at a position between the rearward stabilizer 12 and the forward stabilizer 14. The intermediate stabilizer 32 preferably extends outwardly from both sides of the base beam 6 and assists the forward and rearward stabilizers 14, 12 to prevent the apparatus 2 from tipping. More preferably, the intermediate stabilizer 32 includes at least one stop (and as shown in FIG. 1, most preferably two stops 34) that acts to restrain the range of rotation of the swing arm 18. The stops 34 preferably have a mounting plate and a bumper coupled to the mounting plate. Each mounting plate is coupled to the intermediate stabilizer 32 in any conventional manner, such as by fasteners, welding, brazing, adhesive, and the like, and can even be integral with the intermediate stabilizer.

The intermediate stabilizer 32 can be made to be adjustably positioned along at least a portion of the length of the base beam 6. For example, the intermediate stabilizer 32 can be slidable to different positions along the base beam 6 via a conventional rail assembly, can include one or more conventional releasable fasteners that can be inserted through a slot or desired apertures along the base beam 6, can have a peg or post releasably fitted within such a slot or series of apertures, and the like. The mounting plates can also be adapted for position adjustability upon the intermediate stabilizer 32, such as by being securable upon the intermediate stabilizer 32 in a number of different rotational positions (e.g., by conventional releasable fasteners, by releasable clamps, and the like), by a groove or series of apertures in the intermediate stabilizer 32 into which a releasable fastener or extension of the mounting plates can pass to adjustably fasten the mounting plates to the intermediate stabilizer 32, etc. Adjustment of the intermediate stabilizer 32 and the mounting plates provides control over the rotational arc available to the swing arm 18 between both bumpers. Therefore, the positions of the stops 34 can be adjusted so that a smaller available rotational arc is used for a muscle that has a shorter distance of travel and a larger available rotational arc is used for a muscle with a longer travel distance.

The mounting plates are preferably fabricated from a strong and resilient material such as metal (steel, aluminum, etc.) high-strength plastic, and the like and the bumpers are preferably made from any resilient elastomeric bumper material, such as rubber or urethane. It should be noted that the stops 34 need not necessarily employ mounting plates and bumpers. Instead, other elements such as posts, walls, ramps, or pegs can be secured to or extend from the intermediate stabilizer 32 and can be used as alternatives to the mounting plates and bumpers. Any of these elements can be at least partially made of resilient bumper material, have an element attached thereto that is made of resilient bumper material, and the like. Also, the stops 34 need not be attached to a stabilizer, but can instead be attached to any portion of the apparatus frame 4 (e.g., to the base beam 6). As an example, stops 34 can be defined by the bent or turned ends of a post permanently or adjustably secured to the base beam 6.

It should be noted that although the preferred embodiment has three stabilizers 12, 14, 32, the apparatus 2 can have as few as one and as many as desired. The stabilizers 12, 14, 32 also can be located at different areas than those illustrated (e.g., resulting in a cross-shaped base, a box-shaped base, a triangular-shaped base, a frame of any desired shape, etc.) In addition, the entire base can be the stabilizing element of the apparatus 2, thus eliminating or reducing the need for the individual stabilizers 12, 14, 32. For example, the base can be configured as a large plate having any desired shape and to which the swing arm 18 and the vertical member 58 are attached. Regardless of the structure employed for apparatus stability, one or more bottom surfaces of the elements in contact with the floor are preferably equipped with the no-slip elements, materials or coatings necessary to prevent sliding of the apparatus 2 during operation. Also, it should be noted that the stabilizers or other base structure employed for apparatus stability can be provided with dedicated posts, feet, legs, or other elements (preferably with limited slip elements or surfaces for preventing slip).

The swing arm 18 preferably includes at least one stacking post 36. Preferably, the stacking post 36 includes a stacking plate 38 and stacking boss 40 mounted a distance from the swing arm's rearward end. The stacking plate 38 and boss 40 allow for the placement of weights on the swing arm 18 at desired locations to vary the accelerational and decelerational forces provided by the inertial training apparatus 2. The stacking boss 40 is preferably configured to fit within standard-sized center appertures of weight plates. The stacking plate 38 provides a substantially flat surface for the weight plate to rest against, preventing rocking of the weight plate when the apparatus is in operation. In the preferred embodiment of the invention, two stacking posts 36 are coupled to the swing arm 18. Preferably, the center stacking post 36(*a*) in the illustrated preferred embodiment is located at or near the center of the swing arm 18 and the forward stacking post 36(*b*) is located at or near the forward end of the swing arm 18. By varying the radial distance of the weights from the rotational axis of the swing arm 18, the moment of inertia of the mass is correspondingly altered. For example, when the same weight is moved from the center stacking post 36(*a*) to the forward stacking post 36(*b*), the moment of inertia is increased without adding additional weight. The rotational moment of inertia is a factor of the radial distance and the magnitude of the mass. Because acceleration and decleration forces are dependent upon the magnitude of the rotational moment of inertia, the acceleration forces necessary for rotation and the deceleration forces necessary to stop the rotation are thereby altered accordingly. Therefore, the forces acting on the desired muscle can be altered by adding or subtracting mass, and also by lengthening or shortening the radial distance between the rotational axis of the swing arm 18 and the weight.

As alternatives to the preferred stacking posts 36 of the present invention, a number of other elements and structures can be used to hold or retain weights at one or more desired locations on the swing arm 18. Such alternative stacking elements include stacking bosses 40 acting alone, stacking plates 38 with exterior tabs, bumps, lips, ridges, walls, and the like acting to restrain the weight plate, and the like.

With reference to FIG. 1, although the preferred embodiment preferably has two fixed stacking posts 36(*a*) and 36(*b*) to vary the radial distance of the mass on the swing arm 18, as few as one stacking post 36 adjustable along some length of the swing arm 18 can be used. This can be accomplished by a stacking post 36 that is releasably engagable to different locations on the swing arm 18. For example, the swing arm 18 can have a finite number of mounting holes along the length thereof within which the stacking post 36 can mate in any conventional manner (e.g., light clearance fit, a threaded fit, conventional releaseable ball detent connection, and the like). As another example, the stacking posts 36 can be releaseably secured in an infinite number of locations by using a tightenable vice that clamps to an exterior wall of the swing arm 18. As yet another example, the stacking post 36 can be connected to the swing arm 18 via a track, rail, guide, pin and groove connection, and the like, releaseably engageable in various relative positions of the stacking post 36 and the swing arm 18 in any conventional manner. One having ordinary skill in the art will appreciate that still other manners exist for releaseably engaging the stacking posts 36 in multiple locations along the swing arm 18, each falling within the spirit and scope of the present invention.

Another method that can be used to vary the radial distance of the mass and to thereby vary the rotational moment of inertia is to use a swing arm 18 having at least a portion thereof that can be lengthened and shortened. For example, the swing arm 18 can be one or more telescoping elongated elements. By telescoping one such element within another, the location of the mass upon the swing arm 18 can be changed. As another example, one element defining the swing arm 18 can be slidably secured to another element to accomplish this same function. In any such case, the relative locations of the elements (and therefore, the location of the mass thereon) can be secured by one or more conventional releasable fasteners or clamps, by interlocking ball and detent connection points on the elements, by a pin, post, threaded fastener, and the like releasably engageable within a groove or a plurality of apertures along the elements, etc.). Still other manners of moving and securing one portion of the swing arm 18 with respect to another portion of the swing arm 18 to thereby vary the distance of the mass from the rotational axis of the swing arm 18 are possible and fall within the spirit and scope of the present invention.

The inertial training apparatus 2 also includes a tether 42. The tether 42 is herein defined as a length of flexible material that couples components together allowing for the transfer of tension forces between them. The tether 42 has two ends, one attached to an attachment device 44 preferably on the forward end of the swing arm 18 and the other attached to a handle 46 so as to be easily engageable by a body part. The tether 42 transfers the forces applied by the body part to the swing arm 18 to accelerate the mass and transfers the forces generated by the inertia of the mass to the body part to decelerate the mass.

It should be noted that throughout the specification and claims herein, when the handle 46 is said to be "engageable" to the body part, this does not necessarily mean that the handle 46 is specifically held by the body part. Instead, the term "engageable" means that the handle 46 is either attached directly or indirectly to the body part, having the ability to transfer tension forces between the body part and the tether 42. Examples include using Velcro™ straps, adjustable soft casts for particular body parts, or any other device cabable of transferring force between the body part and the handle 46.

The inertial training apparatus 2 also includes a primary tether guide 48. The tether 42 is passed through the primary tether guide 48 located intermediate between the two ends of the tether 42. The primary tether guide 48 provides a point from which the tether 42 provides acceleration forces and deceleration forces. In a highly preferred embodiment of the present invention, the primary tether guide 48 includes a bracket 50 coupled to the base beam 6 or to another stationary element of the assembly 2. The primary tether guide 48 preferably also includes a horizontal guide 52 and a vertical guide 54, both coupled to the bracket 50 in any conventional manner. The horizontal guide 52 provides a redirection of the tether 42 from the horizontally rotating swing arm 18. The vertical guide 54 redirects the tether 42 to a more user-operable postion preferably located vertically higher than the primary tether guide 48. Preferably, the primary tether guide 48 is located at a point intermediate between the two extreme swing positions of the swing arm 18. More preferably, the primary tether guide 48 is located near the transition position of the swing arm 18 where acceleration forces of the swing arm 18 are transferred into deceleration forces during operation of the apparatus 2 as will be described in more detail below. The primary tether guide 48 can be located at any height, but most preferably is located at substantially the same level as the swing arm 18. In alternative embodiments of the present invention, the primary tether guide 48 can include only a single tether guide capable of smoothly transitioning both the horizontal motion of the tether 42 and the vertical motion of the tether 42, or can include two or more tether guides performing these same functions.

It should be noted that throughout the specification and claims herein, when the tether 42 is said to pass "through" a tether guide, this does not necessarily mean that the tether 42 must pass through an enclosed tether guide. Instead, the term "through" means that the tether 42 is in contact with the tether guide so that the tether guide provides a redirecting force on the tether 42 unless the tether 42 does in fact pass through the tether guide undisturbed. Examples of such tether contact can also be described as bending, sliding, or rolling past or around the tether guide.

The inertial training apparatus 2 preferably has a forward assembly 56 coupled to the base of the apparatus 2, and more preferably to at least one of the forward stabilizer 14 and the base beam 6. The forward assembly 56 has a vertical member 58 and can include a vertical support 60. The vertical support 60 is coupled to the vertical member 58 and to the base beam 6 and/or the forward stabilizer 14 to stabilize and strenghten the forward assembly 56. The vertical support 60 is an attachment and strengthening member to secure the vertical member 58 to the rest of the assembly 2, and can take a number of conventional forms for this purpose, including without limitation a plate (see FIG. 1), buttress, angle iron, or other frame member connected to the vertical member 58 and to the base of the assembly 2 in any conventional manner.

Although not required, one or more additional tether guides can be mounted upon the forward assembly 56 to direct the tether 42 to desired vertical locations along the vertical member 58. These tether guides are preferably similar to the primary tether 48, but can take any conventional form (such as those described above) used for directing force via a cable, rope, or other flexible device. The additional tether guides can be secured in place in any location upon the vertical member 58 or, more preferably, are adjustable to different vertical locations as desired by a user. Tether guide adjustability can be enabled in a number of conventional manners, such as by providing a plurality of mounting holes, an elongated groove or aperture, a track coupled to the vertical member 58, a rail, and the like upon or within which the tether guide is movable or can otherwise be placed. For example, the tether guides can be moved to any of a number of mounting apertures in the vertical member 58, can be slid along a rail on the vertical member 58, can be moved through a groove in the vertical member 58 (see FIG. 1), and the like. In each described embodiment, the tether guides can be secured in a desired position in any conventional manner, including without limitation by one or more clamps, setscrews (preferably with user-manipulatable handles), set pins (spring-loaded or otherwise) engagable in one or more detents or apertures along and in the vertical member 58 and having user-manipulatable handles, etc. Any conventional form of adjusting and securing a tether guide in place upon a frame member can be used for the tether guides of the apparatus 2 and falls within the spirit and scope of the present invention.

In the illustrated preferred embodiment, three additional tether guides are adjustably mounted upon the vertical member 58 for directing the tether 42 to different vertical positions thereon. Specifically, the vertical member 58 has an intermediate tether guide 62, an upper tether guide 64, and a lower tether guide 66. Preferably, all of the tether guides of the forward assembly 56 are individually slidably received within vertical grooves 68 in the vertical member 58 to allow for vertical adjustment. Also preferably, each tether guide 62, 64, 66 can be secured in place within the vertical grooves 68 by a respective threaded clamp fastener (not shown) passed through the vertical member 58 and tether guide 62, 64, 66.

Additional tether guides (that are preferably vertically adjustable as described above) also permit the user to adjust the amount of tether extending from the apparatus 2 for various exercises. For example, it may be desirable in some exercises to have a relatively short amount of tether extending from the apparatus 2 prior to a pulling force exerted upon the tether 42. In such cases, the tether 42 can be passed about an additional tether guide to take up a desired amount of tether slack and then about another tether guide located at a desired height for the particular exercise. Preferably, by adjusting the locations or one or more additional tether guides, a range of slack can be taken up and a range of tether heights can be selected for various exercises, tether pulling angles, and user heights.

In the illustrated preferred embodiment, the tether 42 passes through the intermediate tether guide 62 from the primary tether guide 48 to raise the tether 42 into a more operable elevated positon. From the intermediate tether guide 62, the tether 42 passes through either the upper tether guide 64 or the lower tether guide 66 depending upon the type of exercise undertaken. For example, if the user wishes to train a shoulder muscle, the tether 42 can be passed through the upper tether guide 64 to provide the tether 42 to the subject from a more comfortable and workable position. Likewise, if the subject wishes to train a knee or leg muscle, the tether 42 will most likely pass through the lower tether guide 66 for the same reasons. To permit interchangably feeding the tether through the upper and lower tether guides 64, 66, the upper and lower tether guides 64 and 66 can have a rotating face plate to allow for the quick removal and placement of the tether 42 within the desired tether guide.

Other tether guide structures and manners of changing the feed path of a tether through multiple tether guides are well known to those skilled in the art and are within the spirit and scope of the present invention.

The tether guides 52, 54, 62, 64, 66 are preferrably made from two rollers rotatably mounted between a back plate and a front plate. Each roller rotates about each respective axis. The respective axes are preferably substantially parallel and are separated by a distance that allows the tether 42 to pass between them. Like the horizontal and vertical tether guides 52, 54 of the primary tether guide 48, the other tether guides 62, 64, 66 are not limited to the types illustrated in the preferred embodiment. Rather, any or all of the tether guides can take any shape and form that will allow the tether 42 to pass through while applying redirecting forces to the tether 42 regardless of tether pulling direction. For example, the tether guides can simply be one or more rigidly mounted posts through or past which the tether passes, one or more rotatably mounted rollers, pulleys, rotating pins or pivots, and the like through or past which the tether passes, or one or more slides, grooves, lugs, or channel members through or past which the tether passes, and the like. Such other configurations of tether guides are well known to those skilled in the art and are within the spirit and scope of the present invention.

It should be noted that the inertial training apparatus can be operable without the addition of the forward assembly 56. The forward assembly 56 and the additional tether guides 62, 64, 66 are preferably added to allow for more comfortable and effective positioning of the tether 42 during different exercises. However, the primary tether guide 48, acting alone, provides the necessary redirecting of the tether 42 to adequately operate the inertial training apparatus 2.

The various structural components (base beam 6, rearward stabilizer 12, forward stabilizer 14, swing arm 18, extension member 28, intermediate stabilizer 32, and vertical member 58) of the apparatus 2 are preferably tubular and made from a strong and resilient material such as a metal (steel, aluminum, etc.), high strength plastic, fiberglass, composite, and the like. Although preferably having a rectangular or square cross section, any or all of these structural components can have any hollow or solid cross-sectional shape desired, including without limitation round, oval, polygonal, and flat cross-sectional shapes. In addition, although the swing arm 18 is shown as being substantially elongated and straight in the illustrated preferred embodiment, other shapes and configurations can be used that are capable of supporting and rotating a mass a distance from a pivot point. For example, the swing arm 18 could be oblong, bowed, elliptical, or have any other shape desired. Also, the swing arm 18 need not necessarily be mounted for pivotal movement about an end thereof, and can instead be pivotable about any point on the swing arm 18. In this regard, any conventional pivot connection between the swing arm 18 and the frame (and more preferably, the base beam 6) can be employed. Regardless of the pivot location on the swing arm 18, the swing arm 18 preferably still provides one or more locations for adding mass to the swing arm 18 as described above and for tether attachment.

It should also be noted that the structural components of the apparatus 2 need not be individual components. The illustrated components of the apparatus 2 as shown in FIG. 1 and described above are only those of a preferred embodiment of the present invention. Other structures defining one or more of the structural components in the apparatus 2 are possible. For example, the base beam 6, the rearward stabilizer 12, the forward stabilizer 14, and the intermediate stabilizer 32 can be combined into a single component. As another example, any one or more of the base beam 6, rearward stabilizer 12, forward stabilizer 14, swing arm 18, extension member 28, intermediate stabilizer 32, and vertical member 58 can be defined by multiple elements connected together in any conventional manner.

In operation of the inertial training apparatus 2, the tether 42 is preferably positioned through either the upper 64 or lower tether guide 66 depending upon the desired exercise and the muscle or muscle groups to be exercised. The handle 46 is then engaged by (i.e. grasped by or in any other way attached to) the desired user body part and is moved from an initial body position via a concentric contraction of the muscle(s) thereby pulling the tether 42. The tension created in the tether 42 initiates movement of the swing arm 18 and mass from a first, or starting postion. The starting positon of the swing arm 18 is preferably located adjacent to one of the stops 34 in one of the extreme rotational positions of the swing arm 18, but can be in any position in which pulling of the tether 42 generates rotational movement of the swing arm 18. The tether 42, acting through the series of tether guides 48, 62, (64 or 66), pulls the swing arm 18 via the attachment device 44 on of the forward end of the swing arm 18. The tension force applied to the swing arm 18 from the body part accelerates the mass and swing arm 18 rotationally about the pivot assembly 16, thereby creating an acceleration force. Concentric contractions of the muscle continue to create acceleration forces until the swing arm 18 arrives at the intermediate point substantially aligned with the primary tether guide 48. When the swing arm 18 reaches the intermediate point, the body part preferably reaches its intermediate body point (i.e. mid-way or at least some point along the body part's path of motion during the selected exercise).

The intermediate point is where the concentric contactions of the muscle no longer accelerate the mass and swing arm 18, but instead the eccentric actions of the muscle begin to act to declerate the mass and swing arm 18. In other words, the tether length, measured from the attachment device 44 to the primary tether guide 48, preferably shortens while accelerating the mass and swing arm 18, and lengthens while decelerating the mass and swing arm 18. Preferably, the intermediate point occurs when the distance of the tether 42 reaches its minimum length, and is defined as the position exhibiting the maximum rotational inertia of the swing arm 18 and mass.

After the mass and swing arm 18 pass through the intermediate point, the tether 42 transfers the force generated by the rotational inertia to the connected muscle of the user. The muscle then undergoes an eccentric contraction while acting to decelerate the mass and swing arm 18 to rest (or at least to a point where the direction of motion of the mass and swing arm 18 is reversed). This is the second or final positon of the swing arm 18, which is preferably near but not necessarily touching the second stop. It should be noted, however, that the second or final position of the swing arm 18 can be any position of the swing arm 18 to which the swing arm 18 and mass are decelerated and at which the swing arm 18 and mass reverse direction. Based upon the relative position of the primary tether guide 48 and the available range of motion of the swing arm 18, this second position can be located virtually anywhere in the swing arm's path of motion (and even at the same location as the first position for alternative embodiments of the present invention as described below). At the second or final position of the swing arm 18, the body part is preferably returned to its initial body position, where it can again begin concentric contractions to accelerate the mass and swing arm 18 from its new starting positon.

Preferably, the swing arm 18 traces an arc (or portion of a circle) by moving from the first position to the second position. Between the first and second positions, the swing arm 18 moves through a range of intermediate positions including the intermediate point, which is preferably substantially centrally located between the first and second positions (see FIG. 1) but which can instead be located in other positions in the swing arm's range of motion as desired. A sector is thus preferably defined by the area bound by the swing arm in the first positon and the swing arm in the second position, but is not bound by a finite radius. In other words, the sector encompasses the entire area located between the first and second positions, extending an infinite distance from the pivot axis of the swing arm 18. The primary tether guide 48 is located at some point within the sector for proper apparatus operation, and more preferably is located at a midpoint in the sweep of the sector to define a half-sector for swing arm and mass acceleration and a half-sector for swing arm and mass deceleration. If desired, other locations of the swing arm 18 in the sector can be selected to provide for unequal sector portions for acceleration and deceleration of the swing arm 18 and mass.

As an alternative method of using the present invention, the apparatus 2 can be modified to only allow the swing arm 18 to rotate through a half sector as compared to the full sector of the preferred embodiment. Rather than being defined by the first or initial position of the swing arm 18 and the second or final position of the swing arm 18 as described with reference to the preferred embodiment above, the sector is preferably defined on one side by the first positions and on another side by the intermediate point described above. As such, a half sector of the swing arm's range of motion is defined as the area between the swing arm 18 located at the first position and the swing arm 18 located at the intermediate point. The swing arm 18 therefore moves from the first position to the intermediate point, impacts a member attached to the assembly 2 at or near the intermediate point to reverse direction as described below, and then moves back to the first position. In this alternative embodiment of the present invention, the primary tether guide 48 can be located within the sector as described above with reference to the illustrated preferred embodiment, but more preferably is located at the intermediate point of the swing arm 18.

The reversal of swing arm direction at the intermediate point is accomplished by providing for an elastic collision against the swing arm 18 when it reaches the intermediate point. The collision reverses the rotational direction of the swing arm 18 causing the swing arm 18 to return to the first or starting positon instead of rotating through the intermediate point to the second position described with reference to the illustrated preferred embodiment. The reversed rotational motion of the swing arm 18 still provides the deceleration forces necessary for the eccentric contractions of the user's muscle(s) being trained. Preferably, the collision provides a deceleration force substantially equal to the acceleration force created. The collision against the swing arm 18 at the intermediate point can be provided in a number of different ways, such as by a bumper, stop, spring, or other element mounted upon base beam 6 (e.g., upon an extension, boss, wall, post, or other element extending from the base beam 6 into the path of motion of the swing arm 18). The bumper, stop, spring, or other element is preferably made at least partially of an resilient elastic deformable material capable of absorbing impact from the moving swing arm 18 and of returning the absorbed force to the swing arm 18 to reverse the swing arm's direction at the intermediate point. For example, the contact surface can be one of the stops 34 positioned with respect to the base beam 6 so as not to allow the swing arm 18 to rotate past the intermediate point, while the other stop 34 is positioned away from the intermediate point to allow for motion in that half-sector. Preferably, the intermediate stabilizer 32 can be positioned substantially proximate the rotational center of mass along the swing arm 18 to provide the most efficient collision. However, it is not necessary that the stop 34 be used as the contact surface, or that the contact surface be directly connected to the intermediate stabilizer 32 or to any other element of the frame 4. Instead, the contact surface could be an element independently mounted upon the base beam 6 or a stabilizer of the apparatus 2.

The embodiments described above and illustrated in the drawings are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

Having thus described the invention, what is claimed is:

1. An inertial training apparatus comprising:

a frame;

a carriage having a first end and a second end, the carriage pivotably coupled at the first end to the frame about an axis, the carriage having a first position, a second position, and a range of intermediate positions, the first and second positions of the carriage defining a sector through which the carriage is pivotable;

a tether coupled to the carriage, the tether engageable with a body part;

a tether guide through which the tether passes, the tether guide located within the sector; and the carriage movable from the first position toward the second position via a pulling force upon the tether, at least a portion of the carriage movable back and forth across a line extending through the tether guide and the axis.

2. An inertial training apparatus as claimed in claim 1, further comprising a first mass stacking location adapted to removably receive at least one weight upon the carriage at a first distance from the first end of the carriage.

3. An inertial training apparatus as claimed in claim 2, further comprising a mass removably coupled to the first mass stacking location.

4. An inertial training apparatus as claimed in claim 2, wherein the first mass stacking location is adjustable to vary the first distance from the first end of the carriage.

5. An inertial training apparatus as claimed in claim 2, further comprising a second mass stacking location adapted to removably receive at least one weight upon the carriage at a second distance from the first end of the carriage.

6. An inertial training apparatus as claimed in claim 1, wherein the tether guide is a primary tether guide, the apparatus further comprising a vertical member coupled to the frame, and at least one intermediate tether guide coupled to the vertical member and through which the tether passes, wherein the intermediate tether guide is located between the primary tether guide and the body part along the tether.

7. An inertial training apparatus as claimed in claim 6, wherein the intermediate tether guide is adjustably coupled to the vertical member for variable vertical positioning along the vertical member.

8. An inertial training apparatus as claimed in claim 6, further comprising an upper tether guide coupled to the vertical member and a lower tether guide coupled to the vertical member below the upper tether guide, wherein the tether passes from the intermediate tether guide, through one of the upper and lower tether guides, and then to the body part.

9. An inertial training apparatus as claimed in claim 8, wherein at least one of the upper tether guide and the lower tether guide is adjustably coupled to the vertical member for variable vertical positioning along the vertical member.

10. An inertial training apparatus as claimed in claim 1, further comprising at least one stop at least partially defining an extent of motion of the carriage.

11. An inertial training apparatus comprising:

a frame;

a swing arm having an axis and a length, the swing arm substantially horizontally rotatably coupled to the frame about the axis;

a first mass stacking position on the swing arm at a first distance from the axis;

a primary tether guide coupled to the frame; and a tether moveable through the primary tether guide, the tether having two ends, one end coupled to the swing arm and another end engagable with a body part.

12. An inertial training apparatus as claimed in claim 11, further comprising a mass removably received at the first mass stacking position.

13. An inertial training apparatus as claimed in claim 11, wherein the first mass stacking position is adjustable to vary the first distance from the axis.

14. An inertial training apparatus as claimed in claim 11, further comprising a second mass stacking position on the swing arm at a second distance from the axis.

15. An inertial training apparatus as claimed in claim 11, further comprising:

a vertical member coupled to the frame; and at least one intermediate tether guide coupled to the vertical member and through which the tether passes, wherein the intermediate tether guide is located between the primary tether guide and the body part along the tether.

16. An inertial training apparatus as claimed in claim 15, wherein the intermediate tether guide is adjustably coupled to the vertical member for variable vertical positioning along the vertical member.

17. An inertial training apparatus as claimed in claim 15, further comprising an upper tether guide coupled to the vertical member and a lower tether guide coupled to the vertical member below the upper tether guide, wherein the tether passes from the intermediate tether guide, through one of the upper and lower tether guides, and then to the body part.

18. An inertial training apparatus as claimed in claim 17, wherein the upper tether guide and the lower tether guide are adjustably coupled to the vertical member for variable vertical positioning along the vertical member.

19. An inertial training apparatus as claimed in claim 11, wherein the swing arm is rotatable through a range of positions, the apparatus further comprising at least one stop at least partially limiting the range of positions of the swing arm.

20. A method of using an inertial training apparatus having a swing arm mounted for rotation about an axis, the swing arm rotatable between and including a starting point, an intermediate point, and a finishing point and having a first stacking position located a first distance from the axis, the apparatus having a tether with one end attached to the swing arm and another end engagable by a body part, the method comprising the steps of:

engaging the tether with the body part;

rotationally accelerating the swing arm about the axis from the starting point by pulling upon the tether with the body part;

passing the swing arm though the intermediate point to transition acceleration of the swing arm into deceleration of the swing arm; and rotationally decelerating the swing arm between the intermediate point and the finishing point by resisting the motion of the tether with the body part.

21. The method as claimed in claim 20, wherein the apparatus has a first mass removably received at the first stacking position, the first mass having an magnitude, the method further comprising adjusting the magnitude of the first mass.

22. The method as claimed in claim 21, wherein the apparatus has a second stacking position located a second distance from the axis, and a second mass removably received at the second stacking position, the second mass having a magnitude, the method further comprising adjusting the magnitude of the second mass.

23. The method as claimed in claim 20, further comprising adjusting the first stacking position on the swing arm to change the distance of the first stacking position from the axis.

24. The method as claimed in claim 20, wherein the apparatus includes:

a primary tether guide located adjacent to the swing arm;

a vertical member; and an intermediate tether guide adjustably coupled to the vertical member and located between the primary tether guide and the body part, the method further comprising adjusting a vertical height of the intermediate tether guide coupled to the vertical member.

25. The method as claimed in claim 24, wherein the apparatus has an additional tether guide adjustably coupled to the vertical member and located along the tether between the intermediate tether guide and the body part, wherein the additional tether guide is one of either an upper tether guide substantially above the intermediate tether guide and a lower tether guide substantially below the intermediate tether guide, the method further comprising vertically adjusting the additional tether guide coupled to the vertical member.

26. The method as claimed in claim 25, further comprising removing the tether from the additional tether guide and positioning the tether into another tether guide located on an opposite side of the intermediate tether guide along the vertical member.

27. The method as claimed in claim 20, wherein the apparatus has at least one stop, the method comprising positioning the stop adjacent the swing arm at the finishing point.

* * * * *